US006711753B2

(12) United States Patent
Arai

(10) Patent No.: US 6,711,753 B2
(45) Date of Patent: Mar. 30, 2004

(54) SHIELD FIXING STRUCTURE IN HELMET

(76) Inventor: Michio Arai, c/o ARAI Helmet, Ltd., 12 Azuma-cho, 2-chome, Saitama-shi, Saitama Ken (JP)

( * ) Notice: Subject to any disclaimer, the term of this patent is extended or adjusted under 35 U.S.C. 154(b) by 0 days.

(21) Appl. No.: 10/459,441

(22) Filed: Jun. 12, 2003

(65) Prior Publication Data

US 2003/0196255 A1 Oct. 23, 2003

Related U.S. Application Data

(63) Continuation of application No. 09/987,018, filed on Nov. 13, 2001, now abandoned.

(30) Foreign Application Priority Data

Mar. 29, 2001 (JP) ..... 2001-96692

(51) Int. Cl.[7] ..... A42B 1/08
(52) U.S. Cl. ..... 2/424
(58) Field of Search ..... 2/424, 410, 10, 2/6.3, 6.5

(56) References Cited

U.S. PATENT DOCUMENTS

| | | | | | |
|---|---|---|---|---|---|
| 5,073,990 | A | * | 12/1991 | Kamata | 2/424 |
| 5,095,551 | A | * | 3/1992 | Chin | 2/424 |
| 5,165,117 | A | * | 11/1992 | Kamata | 2/424 |
| 5,177,817 | A | * | 1/1993 | Kamata | 2/424 |
| 5,461,731 | A | * | 10/1995 | Shida | 2/424 |
| 6,301,721 | B1 | * | 10/2001 | Arai | 2/424 |

FOREIGN PATENT DOCUMENTS

| | | | | |
|---|---|---|---|---|
| EP | 475318 A2 | * | 3/1992 | A42B/3/22 |
| JP | 06081206 A | * | 3/1994 | A42B/3/22 |

* cited by examiner

*Primary Examiner*—Rodney M. Lindsey
(74) *Attorney, Agent, or Firm*—Dykema Gossett PLLC

(57) ABSTRACT

A shield fixing structure in which convenience in shield fixing or removing operation is further improved while superior effect in the fixing structure is being assured. This fixing structure is set such that when the stopper is oppositely faced against the passing notch at its full-opened upper limit position, the holding part holds the state to enable a turning of the shield over the full-opened upper limit position of the shield.

16 Claims, 14 Drawing Sheets

SHIELD FIXING STRUCTURE IN HELMET

CROSS-REFERENCE TO RELATED APPLICATION

This application is a continuation of application Ser. No. 09/987,018, filed Nov. 13, 2001, now abandoned, the priority of which is hereby claimed.

BACKGROUND OF THE INVENTION

1. Field of the Invention

This invention relates to a fixing structure for shield installed in a full-face type helmet and an open-face type helmet wearing to protect the head part and the face part of a driver when the driver rides on various kinds of motorized vehicles or moving devices such as a motorcycle and an automobile or the like.

2. Description of the Related Art

The present applicant has already described a proposal in the gazette of Japanese Patent Publication No. Hei 6-60444 about the fixing structure for shield in which when the engagement protuberances are contacted with the stoppers at the full-opened upper limit position of the shield and the engagement protuberances ride over the stoppers, the guide pieces at the hub installed at the fixing parts of the shield are released in engagements with the engagement steps formed at the notches of the hub fitting arranged at the shell, the guide pieces can be removed from the inlet formed at the notch for fitting or removing the guide pieces, the hub is pulled out of the notch under this state, thereby the shield can be removed from the shell.

SUMMARY OF THE INVENTION

The fixing structure described in the gazette is operated such that the shield is turned to the position where the engagement protuberances ride over the stoppers under operation not found in usual use for widening the shield or twisting the shield in consideration of releasing the engagement between the engagement protuberances and the stoppers at a position where the engagement protuberances are contacted with the stoppers in the full-opened upper limit position of the shield, the guide pieces are coincided with the inlet at the aforesaid position to enable it to be removed from the notch of the hub, thereby the shield is removed from the helmet.

In addition, in the case of performing opening or closing operation of the shield under its normal use, the guide pieces and the engagement steps are always engaged with each other, the engagement protuberances are contacted with the stoppers at the full-opened upper limit position of the shield to prevent it from being turned over the former limit position, so that the shield is not removed from the shell.

With the invention described above, when the shield is removed, the shield can be removed through one-finger touch operation without using a setscrew at all.

Problem to be solved by the present invention is to improve convenience in shield fixing or removing operation while holding the superior effect of the fixing structure proposed in the aforesaid gazette and it is an object of the present invention to provide the fixing structure of shield capable of accomplishing the problem.

A technical means employed by the present invention to accomplish the aforesaid object relates to a fixing structure for a shield 1 installed at the front surface of a helmet main body, wherein an engagement protuberance 101 is contacted with a stopper 5 at a full-opened upper limit position of the shield 1, and when the engagement protuberance 101 rides over the stopper 5, a guide piece 81 at a hub 82 installed at a fixing part 2 for the shield 1 is released from the engaged state with the engagement step 33 formed at a notch 31 for supporting the hub 82 of the engagement male members B arranged at right and left sides of a helmet A and can be released from an inlet 32 for releasing the guide piece 81 formed at the notch 31, wherein an engagement protuberance 101 is formed with a passing notch 102 having such a size as one through which the stopper 5 can pass, the stopper 5 can be slid against the engagement male member B to be coincided with or removed from the passing notch 102 and integrally engaged while being always biased in a direction repelling from the passing notch 102, the stopper 5 is held by a holding part 10 for holding a position coinciding with the passing notch 102 at a position above the full-opened upper limit position of the shield 1 under operation of the operating part 93 slid against a biasing force at the full-opened upper limit position of the shield 1, the engagement with the engagement protuberance 101 is released to enable the shield 1 to be turned more upwardly from the full-opened upper limit position and in turn, in the case that the shield 1 is turned from this state to a position where it can be released and that it is not turned up to the position where it can be released and the shield 1 is descended from the full-opened upper limit position, the stopper 5 is released from the holding part 10 and it returns to its initial state with the aforesaid biasing force.

DESCRIPTION OF THE PREFERRED EMBODIMENTS

Figure 1:
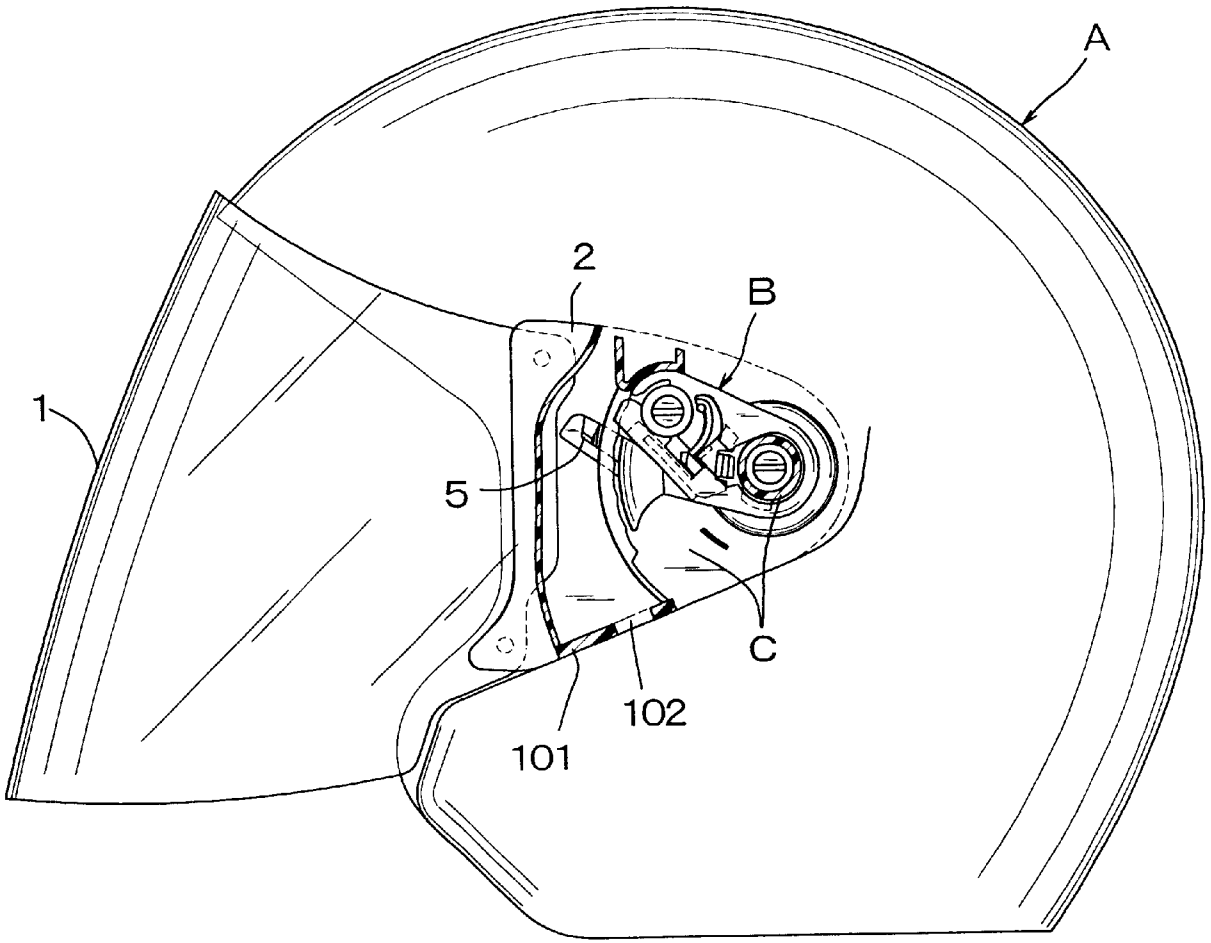
FIG. 1 is a side elevational view showing a helmet to which a fixing structure of the present invention is applied.

The fixing structure described in the gazette of Japanese Patent Publication No. Hei 6-60444 has a click means positioned in a concentric manner with the supporting part acting as a center of turning operation of the shield.

The click means is used for adjusting an opening or closing angle during opening or closing of the shield in a stepwise manner, wherein the shield is held at a predetermined position in a resilient manner in a range from the full-closed lower limit position to the full-opened upper limit position.

The preferred embodiment to be mentioned later will be described in reference to its example provided with a click means. However, the present invention is not limited to the fixing structure provided with the click means.

In addition, the preferred embodiment to be described later will be described in reference to an example in which it is installed in the open face type helmet. However, the fixing structure of the present invention can be installed in a full-face type helmet.

In accordance with the present invention, when the shield 1 is set at the full-opened upper limit position, the engagement protuberance 101 is contacted with the stopper 5 to restrict its more turning operation (refer to FIGS. 5 to 8).

When the stopper 5 is slid from the turning restricted state toward the passing notch 102 under operation of the operating part 93, it is held by the holding part 10 at the position where it is coincided with the passing notch 102 (refer to FIGS. 9 to 12).

Under this state, the guide piece 81 is engaged with the engagement step 33 and this engagement state prevents the hub 82 from being released from the notch 31.

Figure 13:
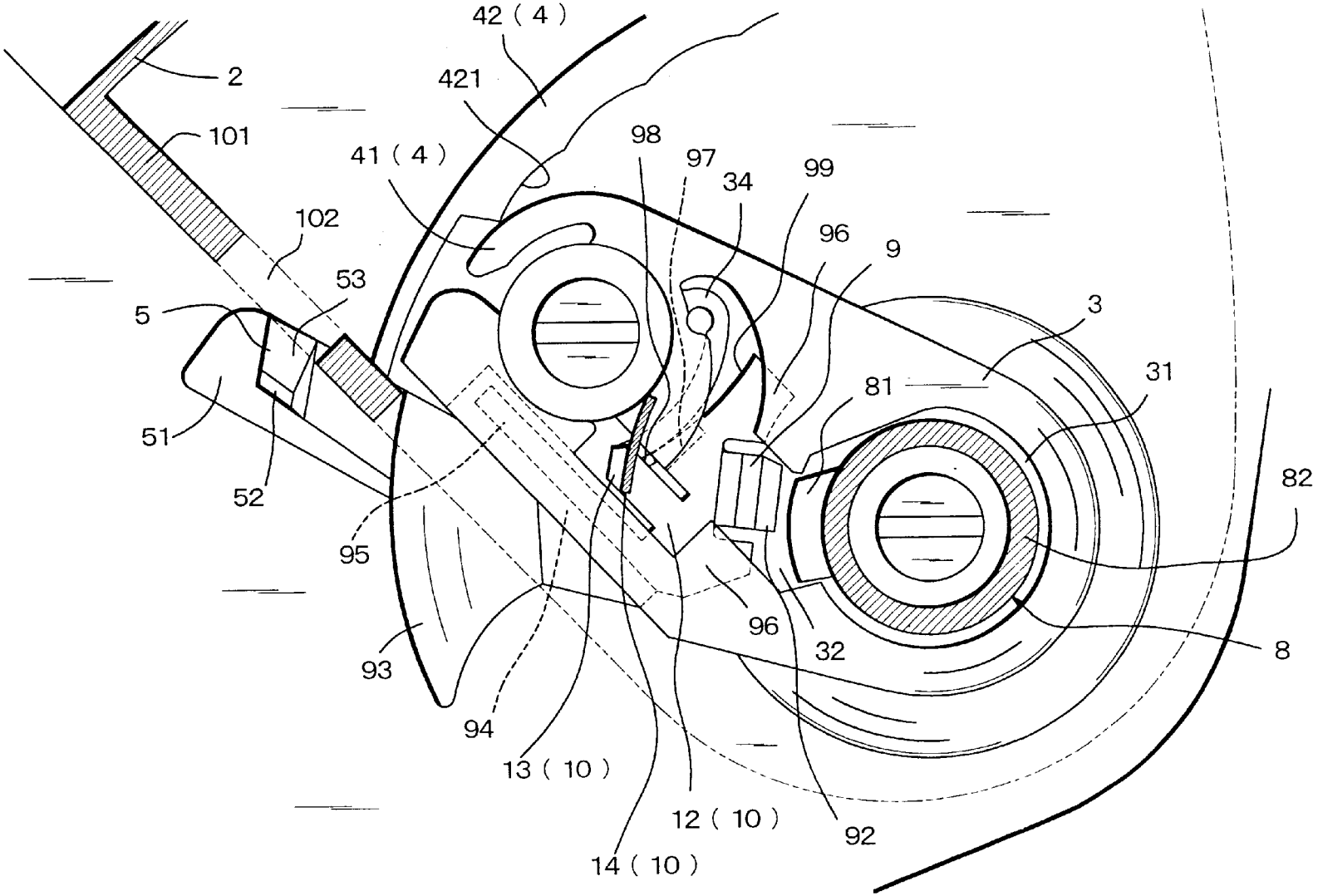
FIG. 13 is an enlarged view showing a substantial part where a shield can be removed.

When the shield 1 is turned upwardly from this state, the passing notch 102 passes through the stopper 5, the engagement protuberance 101 rides over the stopper 5 to cause the engaged state of the guide piece 81 with the engagement step 33 to be released and at the same time the guide piece 81 is coincided with the inlet 32 to enable the hub 82 to be released from the notch 31 (refer to FIG. 13).

Figure 14:
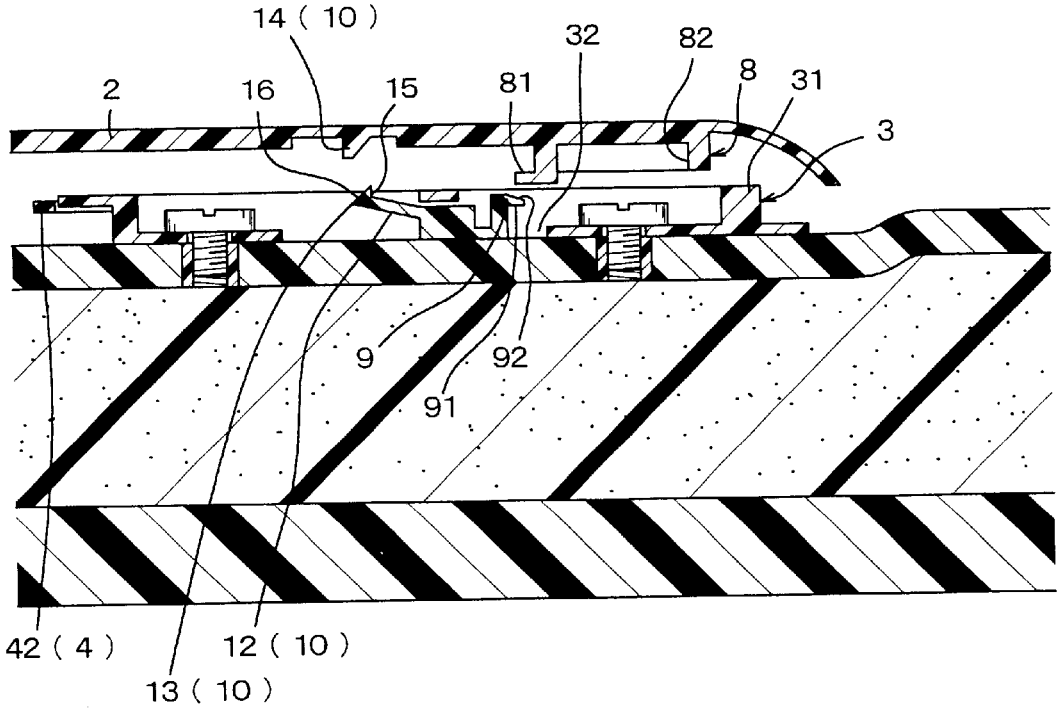
FIG. 14 is a sectional view corresponding to FIG. 3 where the shield is removed.

As the shield 1 is manually widened in an outward direction from the releasing enabled position, or resiliency of the shield 1 is applied, the hub 82 is released out of the notch 31 and the shield 1 is removed (refer to FIG. 14).

When the shield 1 is removed, the stopper 5 is released in its held state with the holding part 10 and at the same time it is slid by a biasing force in such a direction as one in which it is repelled from the passing notch 10 and it is returned back to its initial state (refer to FIG. 14).

Accordingly, if the operating part 93 is operated, it is possible to remove the shield 1 through normal opening operation of the shield 1.

When it is desired to fix the shield 1, the shield 1 is set at the aforesaid removable position, the hub 82 is pushed into the notch 31, resulting in that the pushing surface 92 is pushed by the guide piece 81, it is slid in such a direction as one in which it is released from the notch 31 to release the notch 31, the hub 82 is pushed into the notch 31, the pushing surface 92 slides toward the notch 31 to close the notch 31 and thereby the shield 1 is supported.

Moving amount of the pushing surface 92 at this time is up to a location before the site where the stopper 5 slid under operation of the operating part 93, and it is not held at the holding part 10 through sliding operation of the stopper 5 performed by the fixing operation.

Then, when the shield 1 is turned downwardly, the engagement protuberance 101 rides over the stopper 5, reaches the full-opened upper limit position and the shield 1 becomes a normal state in which it can be turned to open or close as shown in FIGS. 1 to 4.

In the illustrated embodiment, a slant surface inclined toward a thickness direction is formed at a location of the stopper 5 where the engagement protuberance 101 is contacted through lower turning operation of the shield 1, the engagement protuberance 101 moves downward along the slant surface to cause the shield 1 to be gradually widened in an outward direction and ride over the stopper 5 and it is returned back to its original state with its own resilient force in concurrent with this riding over operation.

Referring now to the drawings, one preferred embodiment of the present invention will be described as follows, wherein FIG. 1 shows an open face type helmet A to which the fixing structure of the present invention is applied. B denotes engagement male members installed at the right and left sides of the helmet A. C denotes engagement female members for installing the shield 1 in such a way that it can be turned up and down while being integrally installed at the right and left fixing parts 2 of the shield 1, disengaged or engaged in respect to the engagement male members B.

Since the engagement male members B, the engagement female members C and the fixing parts 2 are the same in their right side and left side structures, only their left side structure will be illustrated and described.

Referring now to FIGS. 2 to 14, the fixing structure of the present invention will be described as follows.

The engagement male member B is comprised of a supporting part 3 becoming a turning center of the fixing part 2; a resilient piece 41 having an arcuate outer circumferential surface constituting one of the click means 4 acted resiliently against turning of the fixing part 2 to restrict its turning operation at a predetermined position; and a stopper 5 for restricting a turning range of the shield 1.

The engagement female member C is comprised of a guide plate 42 constituting the other click means 4 in which several arcuate engagement parts 421 having an outer circumferential surface of the resilient piece 41 adaptively engaged with it by a predetermined angle are formed; and a pivot part 8 rotatably engaged with the supporting part 3.

The supporting part 3 and the resilient piece 41 are integrally molded, generate a resilient force when the supporting part 3 is engaged with the pivot part 8 to cause the outer circumferential surface of the resilient piece 41 to be pushed against the engagement part 421 and then an opening or closing angle of the shield 1 to be adequately changed over.

The stopper 5 is contacted with the engagement protuberance 101 (refer to FIG. 5) arranged in the fixing part 2 at the full-opened upper limit position of the shield 1 to cause a further turning of the shield 1 to be restricted and concurrently when the shield 1 is turned downwardly from the position exceeding the full-opened upper limit position, the engagement protuberance 101 widens the shield 1 in an outward direction, the engagement protuberance 101 rides over the stopper 5 and it is slidably engaged with the engagement male member B and integrally formed with it.

Reference numeral 102 denotes a passing notch (refer to FIGS. 5 and 8) opposing against the stopper 5 when the stopper 5 is slid by the operating lever 93 and then turning of the shield 1 causes the passing notch to pass by the stopper 5 and enables the shield 1 to be turned over the full-opened upper limit position.

As to the constitution of the supporting part 3 and the pivot part 8, it is the same as that disclosed in the gazette of Japanese Patent Publication No. Hei 6-60444, so that its practical description is eliminated. In the figure, reference numeral 31 denotes a notch part, reference numeral 32 denotes an inlet, reference numeral 33 denotes an engagement step, reference numeral 81 denotes a guide piece and reference numeral 82 denotes a hub.

The stopper 5 will be described in detail as follows.

The stopper 5 has a protuberance shape in the same manner as that disclosed in the gazette of Japanese Patent Publication No. Hei 6-60444, wherein its side facing the full-opened upper limit position is applied as a vertical surface part 52 and its opposite side is applied as a slant surface part 53, its size is set to such a value as one in which it may pass through the passing notch 102.

Further, a closing part 9 for closing the inlet 32 of the supporting part and an operating part 93 (called as an operating lever) for slidingly operating the stopper 5 are integrally provided through a connecting plate 51, and the closing part 9 is always biased in such a direction as one in which it closes the inlet.

The closing part 9 has a guiding surface 91 for pressing the upper surface of the guide piece 81 and a pushing surface 92 cooperatively arranged at the guiding surface and inclined toward its thickness. When it is slid as the stopper 5 slides and it is placed at a position where it can enter or come out of the inlet 32 and further the stopper 5 is moved away from the passing notch 102 and can be contacted with the engagement protuberance 101, the closing part 9 closes the inlet 32, the guiding surface 91 guides the turning operation of the guide piece 81 as the hub 82 is turned, and under a state in which the stopper 5 faces against the passing notch 102, the closing part 9 releases the inlet 32 to release the guide of the guide piece 81 (refer to FIGS. 5, 6, 9 and 10).

Further, when the shield 1 is fixed, the hub 82 is fitted to the notch 31. In this case, the guide piece 81 pushes against the pushing surface 92, thereby the closing part 9 slides in a guide releasing direction to release the inlet 32 and it closes by a biasing force in concurrent with operation in which the hub 82 is fitted to the notch 31.

Figure 9:
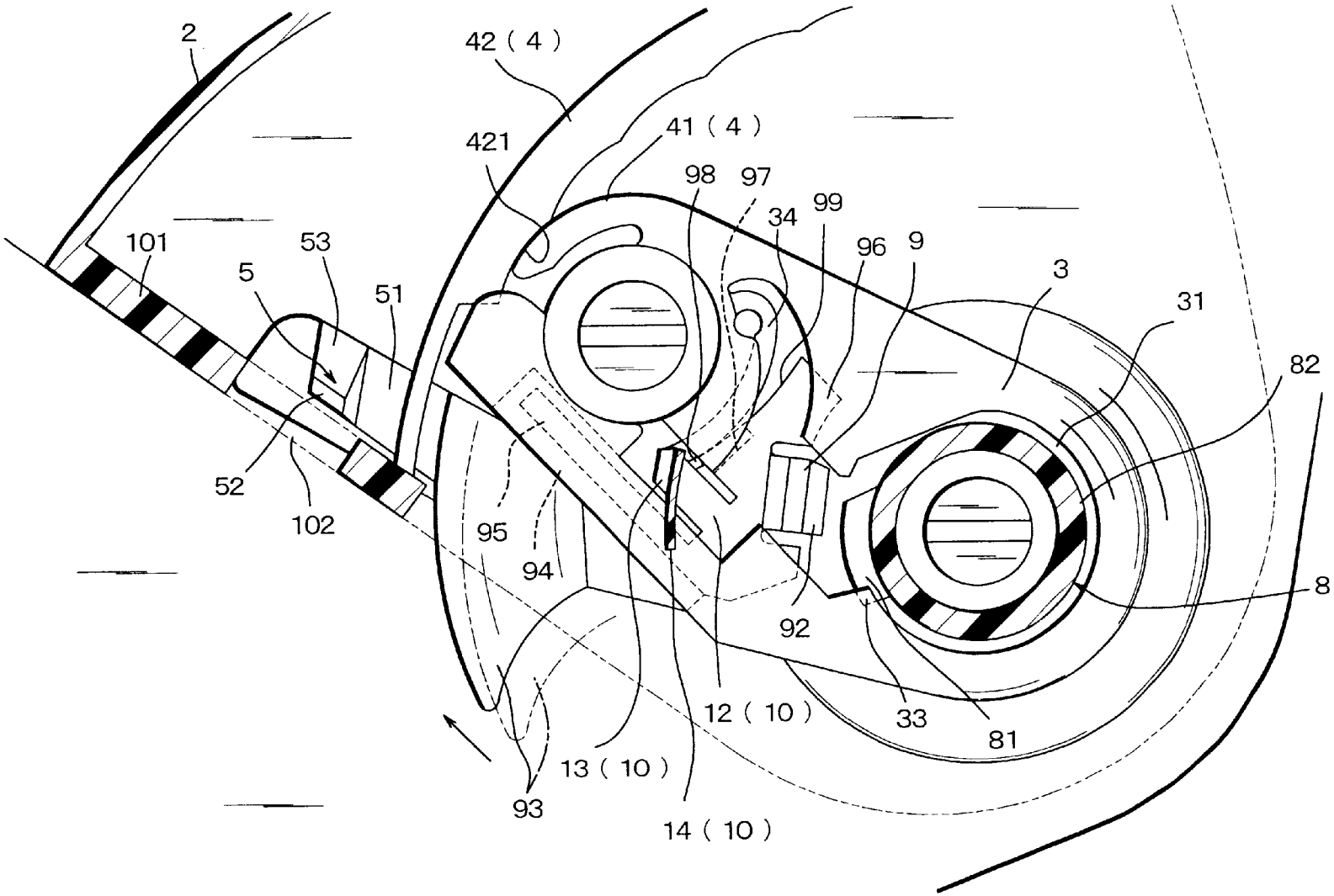
FIG. 9 is an enlarged view showing a state in which a stopper slides and faces against a passing notch.
Figure 10:
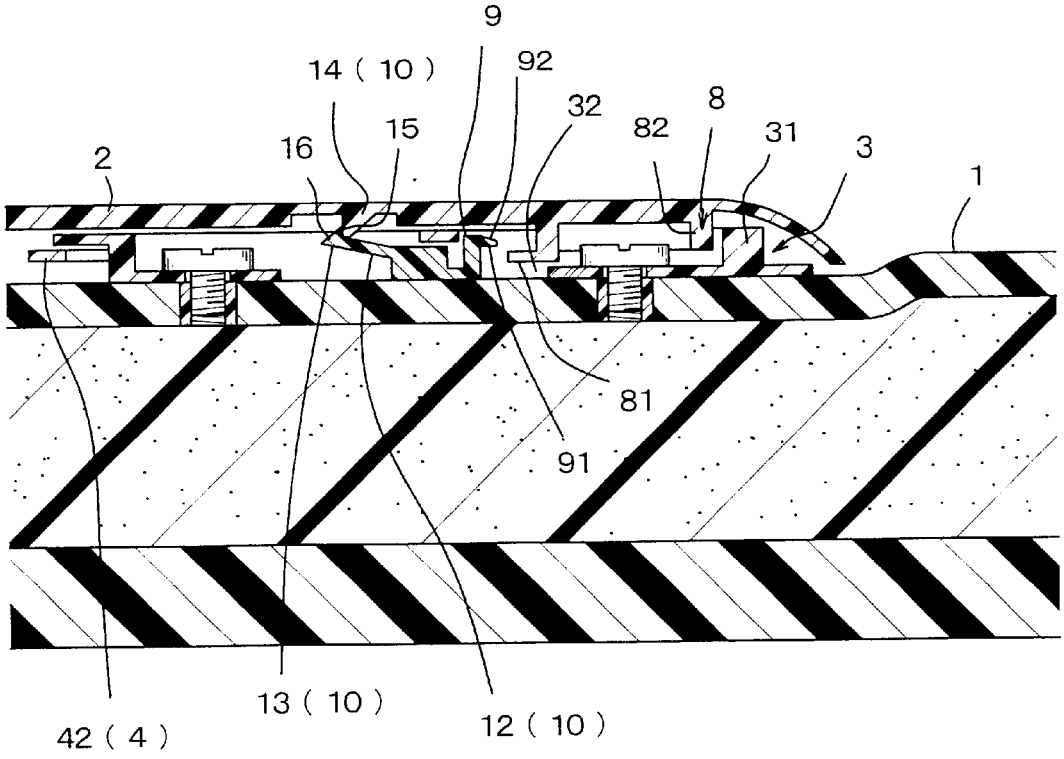
FIG. 10 is a sectional view corresponding to FIG. 3 under a state of FIG. 9.
Figure 11:
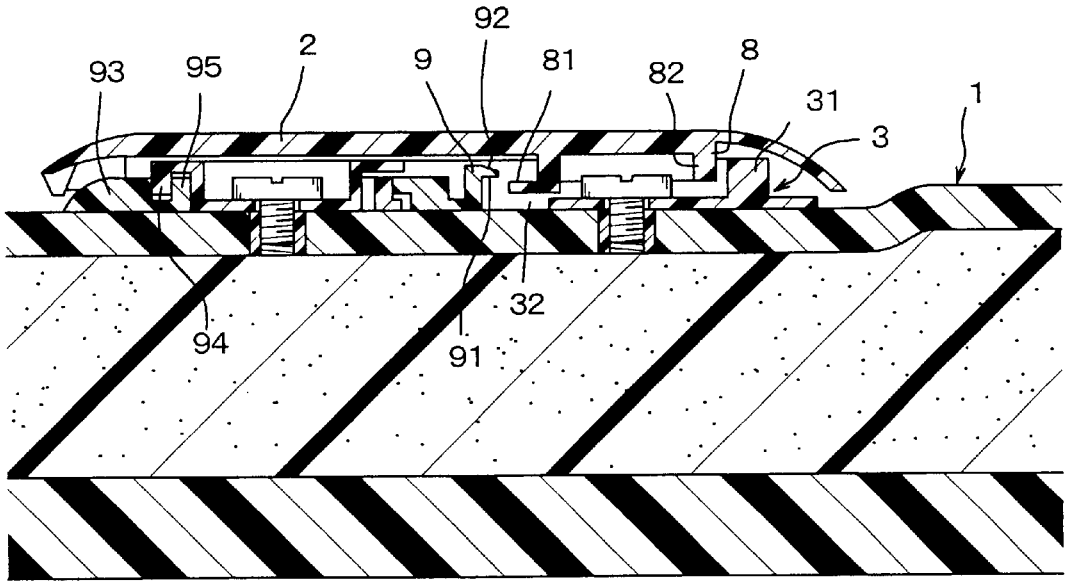
FIG. 11 is a sectional view corresponding to FIG. 7 under a state of FIG. 9.
Figure 12:
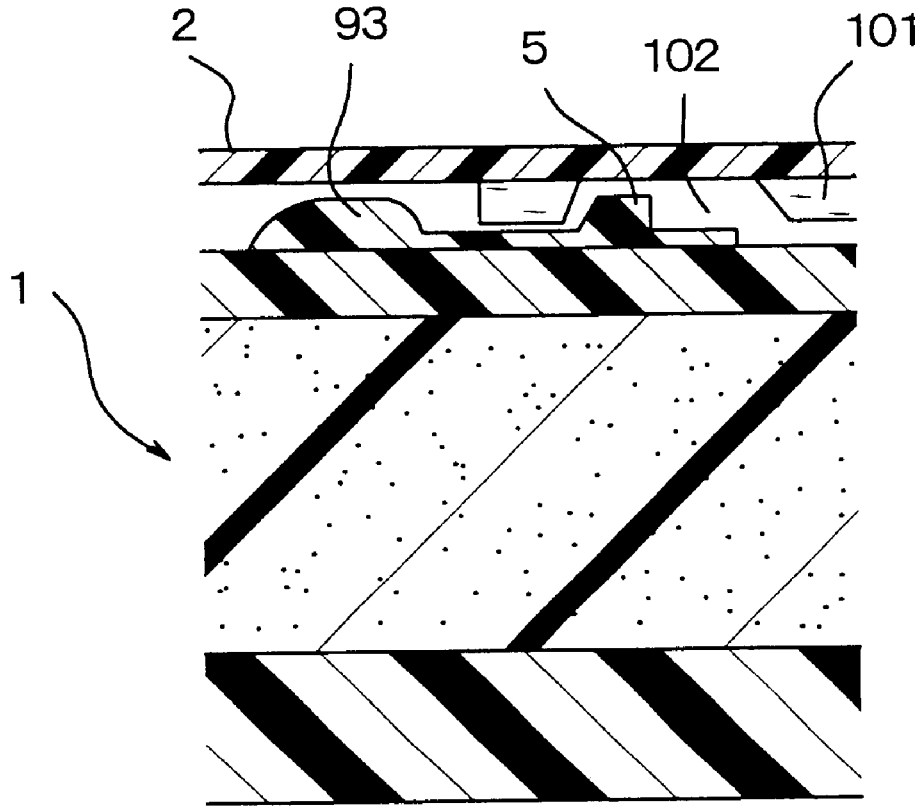
FIG. 12 is a sectional view corresponding to FIG. 8 under a state of FIG. 9.

The operating lever 93 is set at such a position as one in which it is exposed to be enabled to operate at the full-opened upper limit position of the shield 1 (refer to FIG. 9).

Reference numeral 34 denotes a leaf spring which is integrally arranged at the engagement male member B so as to bias the stopper 5 in the aforesaid direction.

The leaf spring 34 pushes against a pushing wall 92 integrally arranged at the connecting plate 51 behind the closing part 9 and the stopper 5 is biased by the biasing force in a direction moving away from the passing notch 102.

Biasing force of the leaf spring 34 biases the stopper 5 in such a direction as one in which the closing part 9 always closes the inlet 32.

Sliding structure of the stopper 5 is made such that a protuberance 94 integrally formed with the engagement male member B and formed along a sliding direction of the stopper 5 is held by a protuberance 95 integrally formed at the location opposing against the protuberance 94 of the connecting plate 51 and by the operating lever 93 to cause the stopper 5 to be slid (refer to FIGS. 2, 4, 7 and 11).

In addition, the connecting plate 51 is held at its front side and rear side to cause the stopper 5 and the engagement male member B to be integrally engaged to each other.

Figure 2:
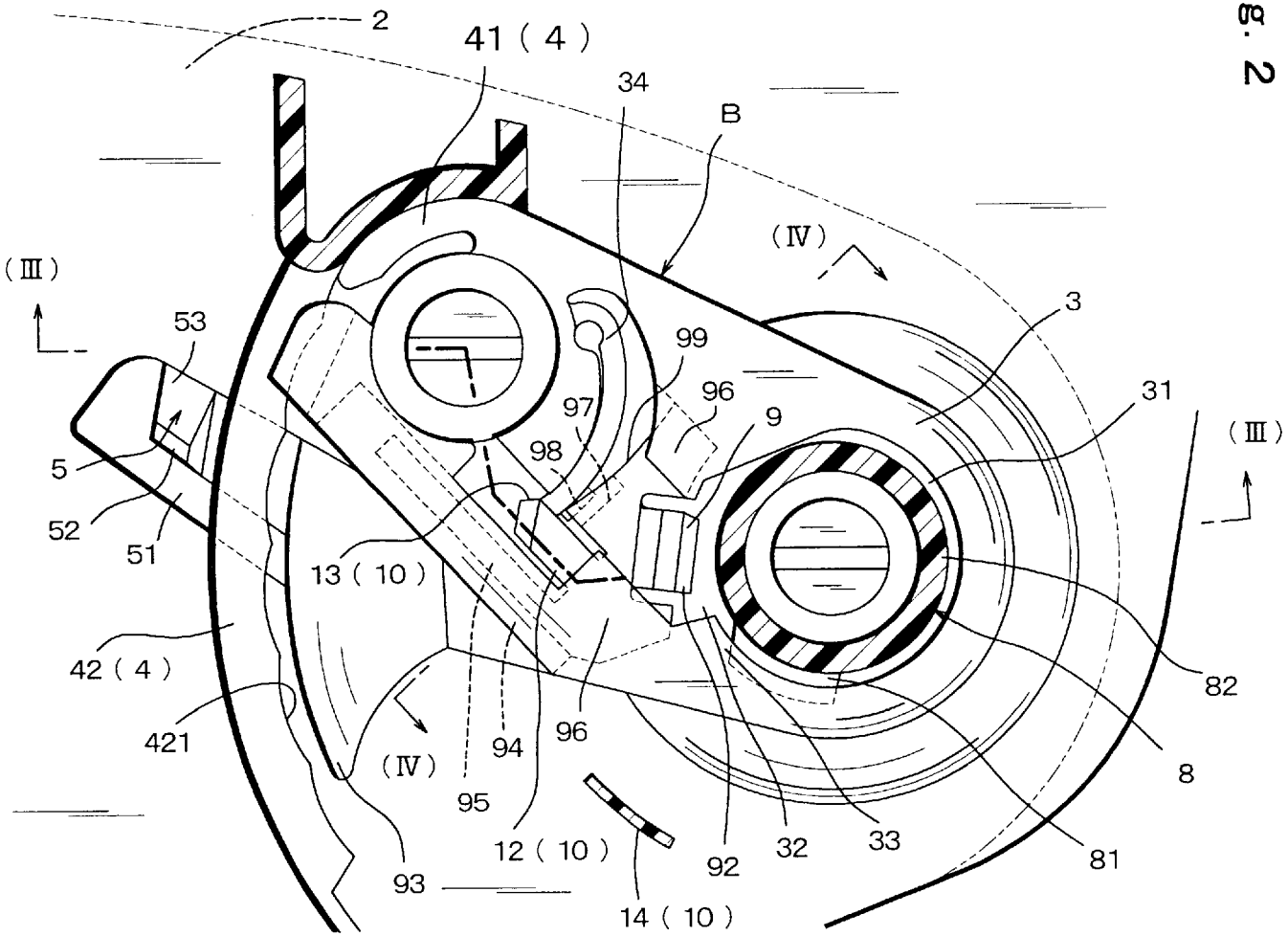
FIG. 2 is an enlarged view showing a substantial part of FIG. 1.
Figure 3:
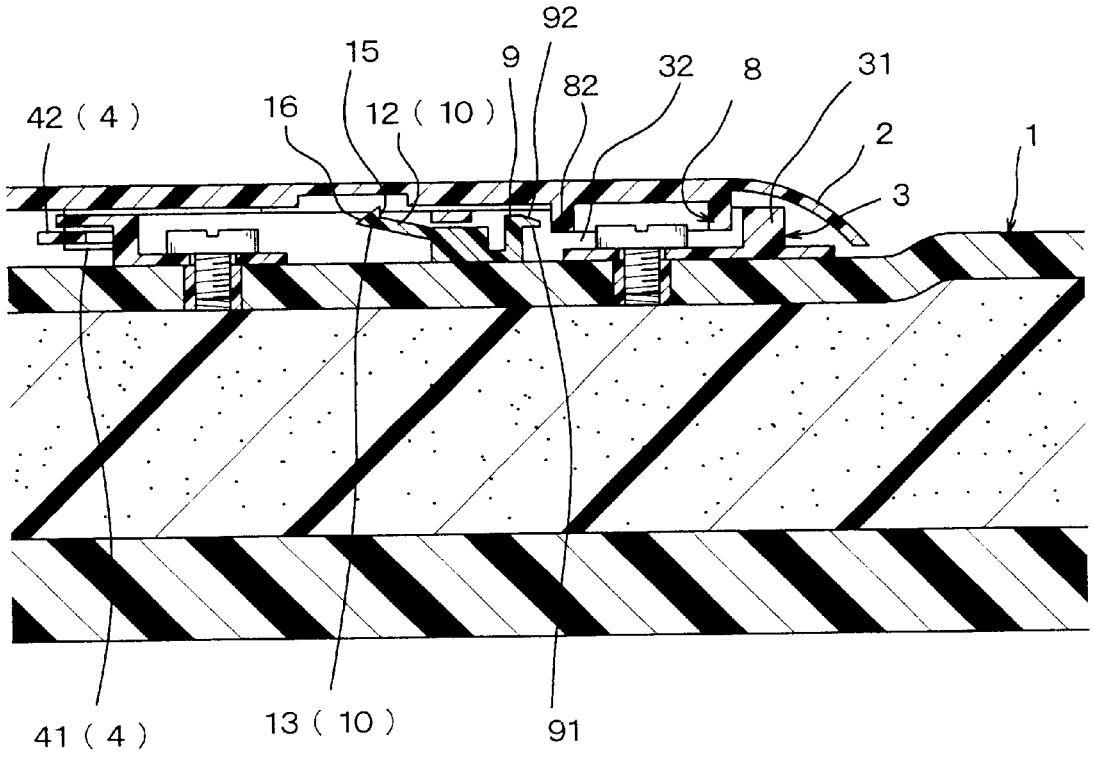
FIG. 3 is a sectional view taken along line III—III of FIG. 2.
Figure 4:
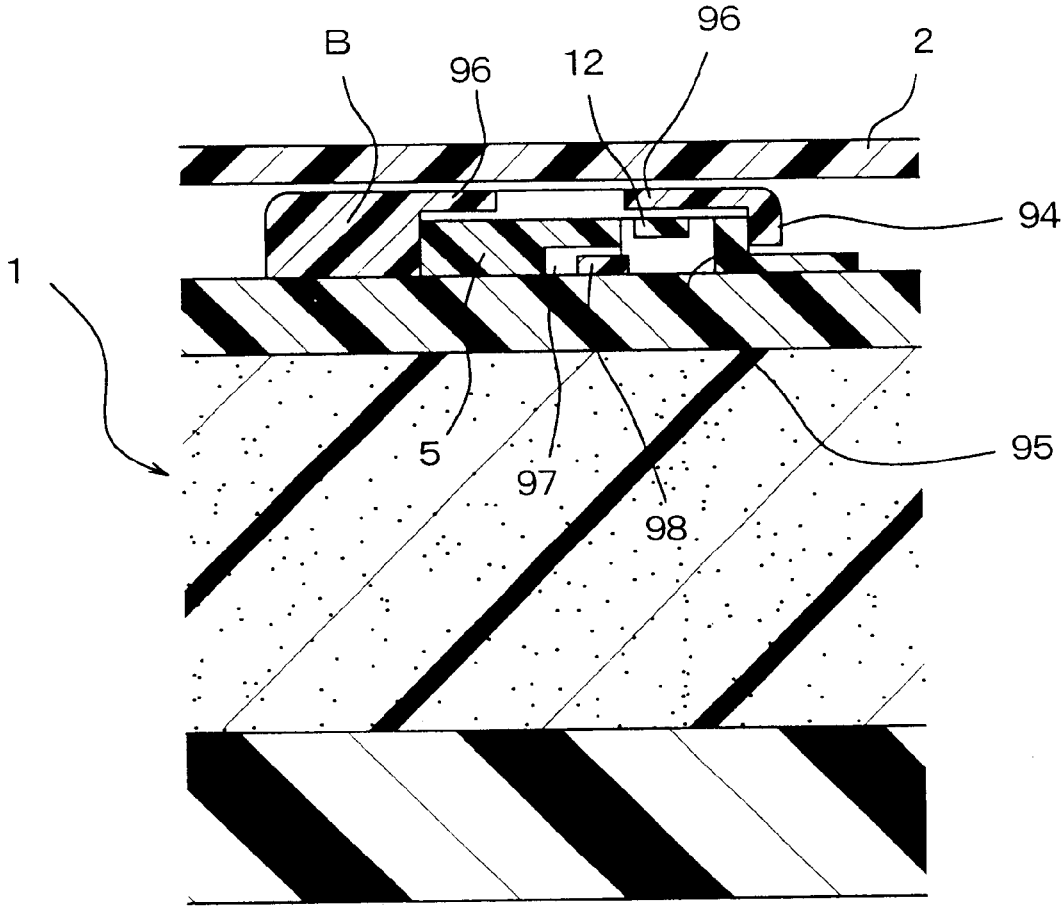
FIG. 4 is a sectional view taken along line IV—IV of FIG. 2.
Figure 5:
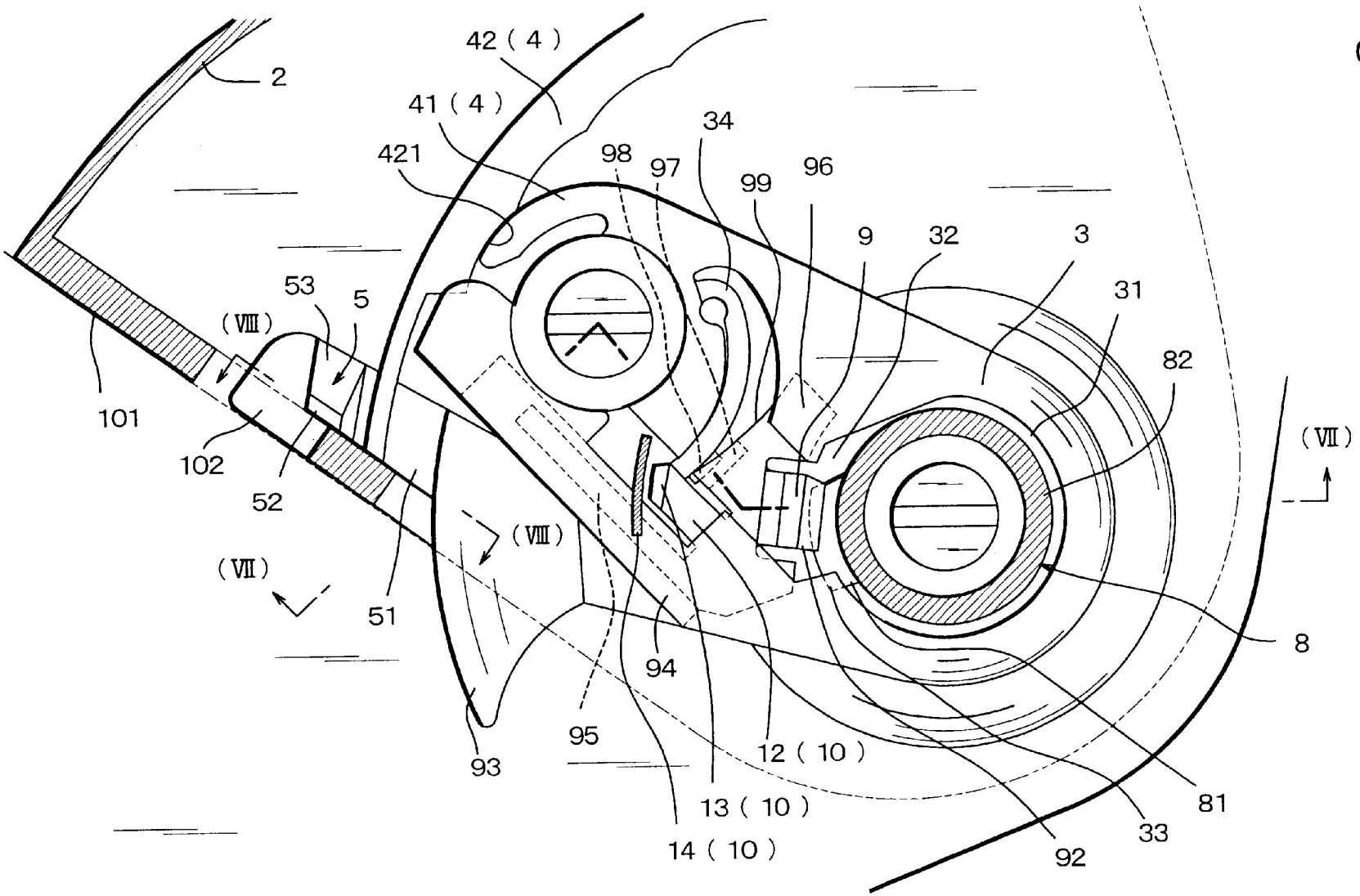
FIG. 5 is an enlarged view showing a state in which a shield is set at its full-opened upper limit position.
Figure 6:
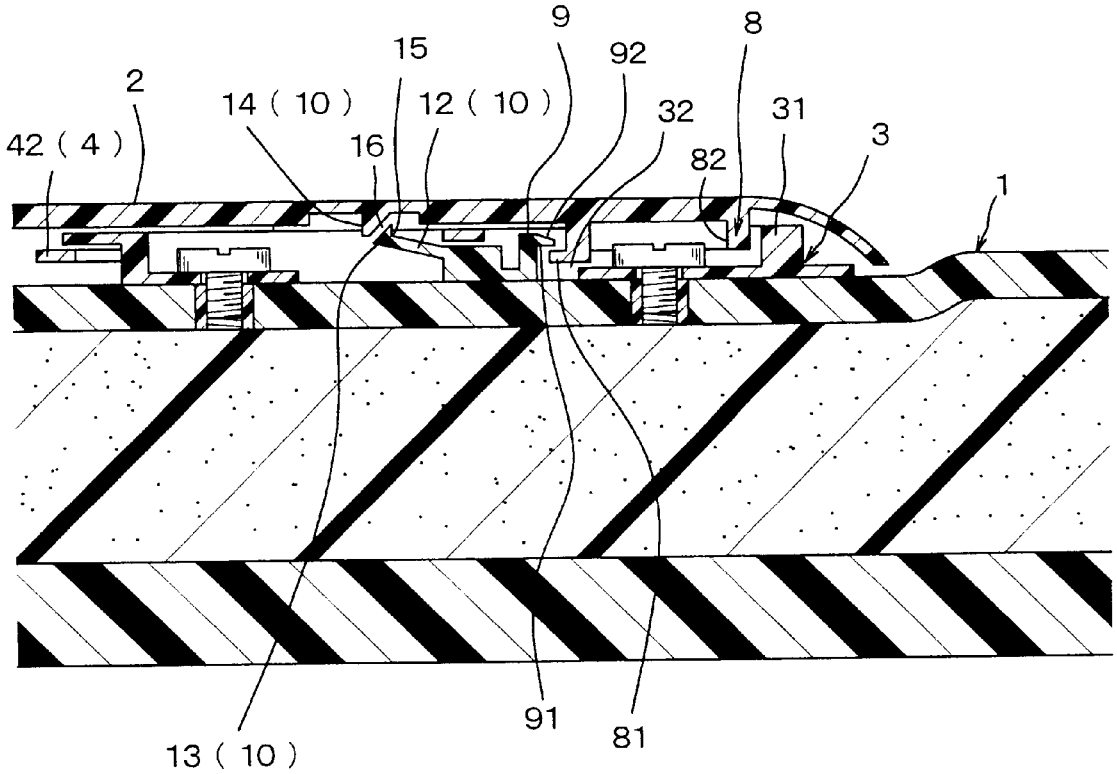
FIG. 6 is a sectional view corresponding to FIG. 3 at a state shown in FIG. 5.
Figure 7:
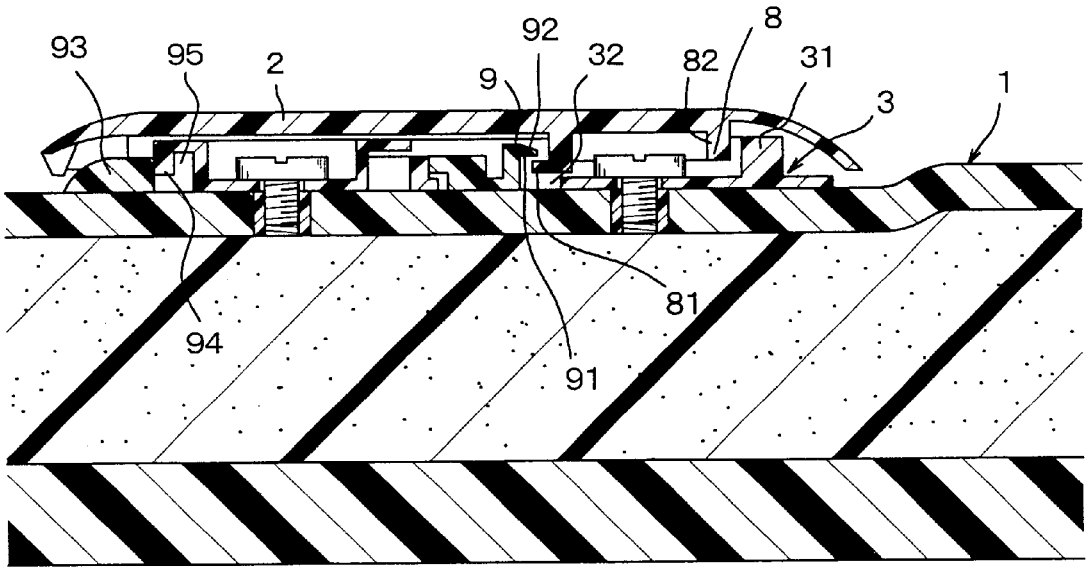
FIG. 7 is a sectional view taken along line VII—VII of FIG. 5.
Figure 8:
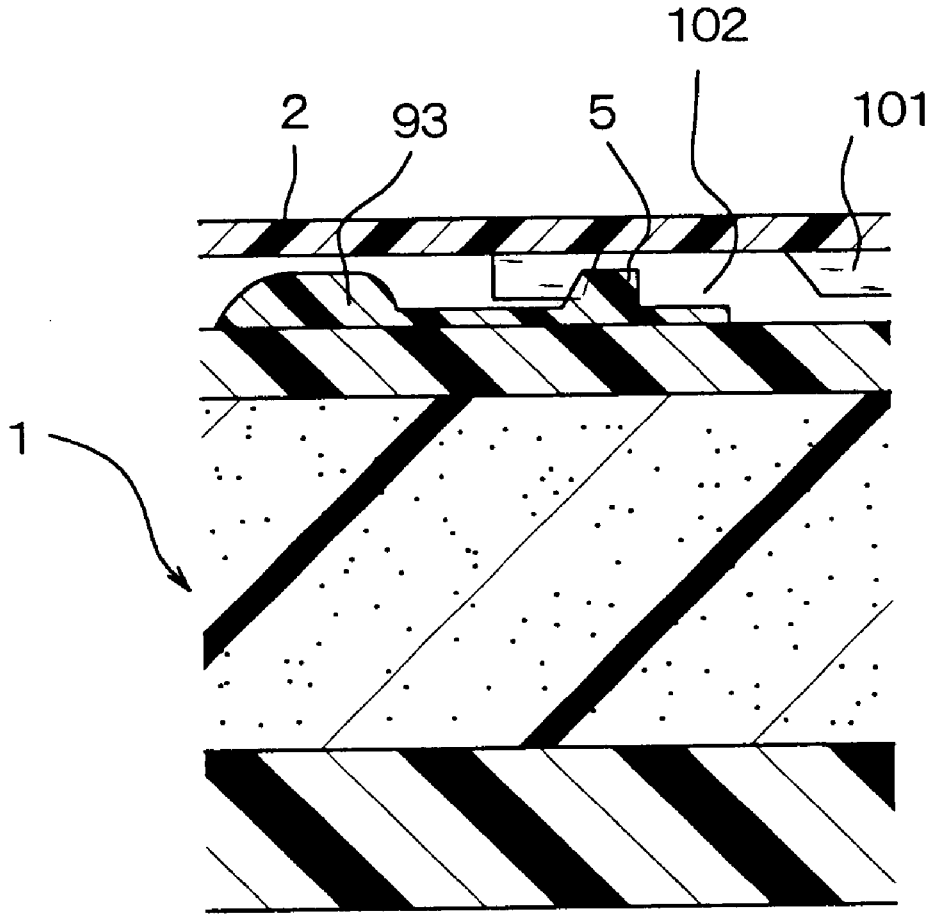
FIG. 8 is a sectional view taken along line VIII—VIII of FIG. 5.

More practically, the end part of the raised portion of the protuberance 95 and the pressing plate 96 for pressing the front surface side of the connecting plate 51 are integrally arranged at the base part of the protuberance 94 and in turn the extremity end side of the leaf spring 34 is formed with a pressing protuberance 98 for pressing the rear surface side of the connecting plate 51 while being engaged with the engagement notch 97 arranged at the lower end of the pressing wall 92, the front side and the rear side of the connecting plate 51 are held by these pressing plate 96 and pressing protuberance 98 to cause the stopper 5 to be integrally engaged with the engagement male member B (refer to FIGS. 2 and 4).

With such an arrangement as above, the stopper 5 is slidably and integrally engaged with the engagement male member B to become one unit, so that its installing work to the helmet A becomes quite easy.

Reference numeral 10 denotes a holding part for keeping opposed states of both stopper 5 and passing notch 102 when the stopper 5 slides in the passing notch 102 and for holding the released state of the closing part 9.

The holding part 10 is constituted by a deformed plate 12 constituting one of the holding parts 10 and integrally arranged at the connecting plate 51 with resiliency; a hook protuberance 13 integrally projected outside the extremity end of the deformed plate 12; and a hook stopper 14 constituting the other of the holding parts 10, arranged at the fixing part 2 and having the hook protuberance 13 engaged with it.

The hook protuberance 13 is comprised of a hook surface 15 hooked with the hook stopper 14 at its extremity end, and a slant surface 16 cooperatively arranged at the hook surface 15 and inclined at its extremity end and toward its thick portion. When the stopper 5 slides toward the passing notch 102, the slant surface 16 is pushed while being contacted with the hook stopper 14 to cause the deformed plate 12 to be flexed inward, thereby the hook protuberance 13 rides over the engagement (hook) stopper 14, the deformed plate 12 returns back to its original state by its resiliency and the hook surface 15 is hooked to the hook stopper 14.

The hook stopper 14 is set to have such a length as one to cause the hook protuberance 13 to be hooked when the shield 1 is over the full-opened upper limit position and it is raised into an arcuate shape in concentric with the pivot part 8.

Fitting and removing operations for the shield having such a fixing structure as one described above will be described as follows.

At first, when the shield 1 is turned upward to reach its full-opened upper limit position, the stopper 5 is contacted with the engagement protuberance 101, its further turning is restricted and at the same time the operating lever 93 is exposed at the state in which it can be operated and the hook stopper 14 reaches such a position as one in which the hook protuberance 13 can be engaged (refer to FIGS. 5 to 8).

When the operating lever 93 is slid from the turning restricted state against the biasing force of the leaf spring 34, the stopper 5 slides and reaches a location where the passing notch 102 can be passed and concurrently the closing part 9 slides to come out of the inlet 32 and releases guiding of the guide piece 81, and further the hook protuberance 13 is engaged with the hook stopper 14 to keep the hook released state and the passing enabled state (refer to FIGS. 9 to 12).

Under this state, the guide piece 81 and the engagement step 33 are engaged to each other to prevent the hub 82 from being removed from the notch 31.

When the shield 1 is turned upward from the hook released state and the passing enabled state, the passing notch 102 passes through the stopper 5, the engaged state between the guide piece 81 and the engagement step 33 is released, the guide piece 81 is coincided with the inlet 32 in such a way that it can be pulled out of it, thereby the hub 82 can be removed from the notch 31 (refer to FIG. 13).

The shield 1 is widened outwardly by its own resilient force in concurrent with the removing enabled state, the hub 82 is removed from the notch 31 and the shield 1 is removed (refer to FIG. 14).

When the shield 1 is removed, the hook protuberance 13 is released from the hook stopper 14 and the stopper 5 slides by a biasing force of the leaf spring 34 in a direction where it is repelled from the passing notch 102 and at the same time the closing part 9 closes the inlet 32 and it is returned back to its initial state (refer to FIG. 14).

In order to fix the shield 1, the shield 1 is positioned at the aforesaid removing-enabled state, the hub 82 is pushed into the notch 31, the guide piece 81 pushes against the pressing surface 92 as described above, the closing part 9 is slid in a guide releasing direction to release the inlet 32.

In concurrent with fitting of the hub 82 with the notch 31, the closing part 9 returns back to its original state by the biasing force to close the inlet and then the guiding of the guide piece 81 is started.

As the shield 1 is turned downwardly from this state, the engagement protuberance 101 moves along the slant surface 53 of the stopper 5 in the same manner as that described in the gazette, the shield 1 widens gradually in an outward direction, the engagement protuberance 101 rides over the stopper 5 and at the same time, the shield 1 returns back to its original state by its own resilient force, thereby it becomes a normal openable or closable turning state shown in FIGS. 1 to 4.

As described above, the present invention can provide the fixing structure for the shield in which the shield fixing or removing operation can be carried out in its improved convenience upon holding the superior effect of the fixing structure proposed in the aforesaid gazette due to the fact that the shield can be removed under normal opening operation performed through operation of the operating part.

In addition, the state in which it is oppositely faced against the passing notch of the stopper is held by the holding part, the shield can be turned without releasing and keep on stopping the stopper with a hand of the user by himself or by herself.

Then, under a state in which the stopper is slid and held at the full-opened upper limit position, the guide piece is engaged with the engagement step to hold the fixed state of the shield, the shield is turned more upward from the full-opened upper limit position, thereby the engagement between the guide piece and the engagement step is released for the first time to enable the guide piece to be removed from the inlet, so that even if the operating part is operated erroneously at the full-opened upper limit position, the shield can not be released only by this operation.

Further, if it is turned downward from the full-opened upper limit position where the stopper is held, the held state of the stopper is released automatically, so that even if the stopper is slid erroneously at the full-opened upper limit position and so on, it can be returned rapidly back to a normal shield fixing state.

Accordingly, it is possible to prevent the shield from being removed during the normal shield opening or closing turning operation.

Further, the engagement male member and the stopper are integrally engaged with each other to accomplish one unit, so that its installing work for the helmet or its decomposing or maintenance work becomes quite easy.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A shield fixing structure for attaching a shield to a helmet, the shield fixing structure having two components, one attached to each side of said helmet with said shield extending therebetween, each of said components comprising:

a male engagement member capable of being connected to the helmet, said male engagement member having a stopper for restricting movement of said shield;

a female engagement member movably connected to the male member, said female engagement member having a fixing part for attaching said two components with said shield; and a passing notch for opposing said stopper when said shield is rotated to an open position from a closed position, and for passing over said stopper when said shield is rotated to a removal position for removal from said helmet, wherein said components are mirror images of one another and are located on opposite sides of said helmet, each end of said shield is attached with said female engagement members which provide a base for rotation of said shield, said shield is capable of being rotated between a closed position and an open position, and is also capable of being removed from said helmet.

2. The shield fixing structure according to claim 1, wherein:

said fixing part further comprises an engagement protuberance that is slidably engaged with said male engagement member.

3. The shield fixing structure according to claim 2, wherein:

said female engagement member has a pivot part;

said shield rotates about said pivot part when being changed from one position to another, and when being removed from said helmet.

4. The shield fixing structure according to claim 3, wherein:

said pivot part further comprises a hub and a guide piece;

said male engagement member further comprises an inlet;

said hub having central axis about which said hub rotates;

said pivot part is in rotating engagement with said male engagement member, wherein when said pivot part was rotated about said hub and said guide piece coincides with said inlet, said female engagement member is capable of being removed from engagement with said male engagement member thereby allowing the shield to be removed from the helmet.

5. The shield fixing structure according to claim 4, wherein:

said engagement protuberance has said notch, wherein said stopper passes through said notch when said shield is being removed from said helmet.

6. The shield fixing structure according to claim 5, wherein:

said stopper has a protrusion with a vertical surface and a slant surface; and said stopper has a slide that causes said stopper to move when operated, wherein said protrusion of said stopper passes through said notch when said shield is being removed from said helmet, and abuts said engagement protuberance when said shield is moved to an open position.

7. The shield fixing structure according to claim 6, wherein:

said male engagement member has a supporting part that is engaged with said pivot part of said female engagement member;

said supporting part facilitates the relative rotation of said male engagement member and said pivot part of said female engagement member.

8. The shield fixing structure according to claim 7, wherein:

said female engagement member further comprises a guide plate with notched edge with a plurality of arcuate shaped notches; and said male engagement member further comprises a resilient piece having at least one arcuate shaped edge, wherein said resilient piece matingly engages said notched edge of said guide plate when said shield is rotated from one position to another position, and said resilient piece generates a resilient force when said supporting part is engaged with said pivot part which causes an outer circumferential surface of said resilient piece to be pushed against said fixing part.

9. A shield fixing structure comprising:

a helmet;

a shield;

two shield fixing components, each of said shield fixing components comprising:

a male engagement member capable of being connected to the helmet, said male engagement member having a stopper for restricting movement of said shield;

a female engagement member movably connected to the male member, said female engagement member having a fixing part for attaching said female engagement member with said shield; and a passing notch for opposing said stopper when said shield is rotated to an open position, and for passing over said stopper when said shield is rotated to a position wherein it can be removed from said helmet, wherein said shield fixing components are located on opposite sides of said helmet and attach said shield to said helmet.

10. The shield fixing structure according to claim 9, wherein:

said fixing part further comprises an engagement protuberance that is slidably engaged with said male engagement member.

11. The shield fixing structure according to claim 10, wherein:

said female engagement member has a pivot part;

said shield rotates about said pivot part when being changed from one position to another, and when being removed from said helmet.

12. The shield fixing structure according to claim 11, wherein:

said pivot part further comprises a hub and a guide piece;

said male engagement member further comprises an inlet;

said hub having central axis about which said hub rotates;

said pivot part is in rotating engagement with said male engagement member, wherein when said pivot part was rotated about said hub and said guide piece coincides with said inlet, said female engagement member is capable of being removed from engagement with said male engagement member thereby allowing the shield to be removed from the helmet.

13. The shield fixing structure according to claim 12, wherein: said engagement protuberance has said notch, wherein said stopper passes through said notch when said shield is being removed from said helmet.

14. The shield fixing structure according to claim 13, wherein:

said stopper has a protrusion with a vertical surface and a slant surface; and said stopper has a slide that causes said stopper to move when operated, wherein said protrusion of said stopper passes through said notch when said shield is being removed from said helmet, and abuts said engagement protuberance when said shield is moved to an open position.

15. The shield fixing structure according to claim 14, wherein:

said male engagement member has a supporting part that is engaged with said pivot part of said female engagement member;

said supporting part facilitates the relative rotation of said male engagement member and said pivot part of said female engagement member.

16. The shield fixing structure according to claim 15, wherein:

said female engagement member further comprises a guide plate with notched edge with a plurality of arcuate shaped notches; and said male engagement member further comprises a resilient piece having at least one arcuate shaped edge, wherein said resilient piece matingly engages said notched edge of said guide plate when said shield is rotated from one position to another position, and said resilient piece generates a resilient force when said supporting part is engaged with said pivot part which causes an outer circumferential surface of said resilient piece to be pushed against said fixing part.

* * * * *